United States Patent [19]

Kohno et al.

[11] Patent Number: 4,561,333

[45] Date of Patent: Dec. 31, 1985

[54] DIAMOND TURNING METHOD FOR HIGH-PRECISION METAL MIRROR

[75] Inventors: Tsuguo Kohno, Tokorozawa; Yoshitaro Yoshida, Chiba; Koji Tenjinbayashi; Yuichi Okazaki, both of Ibaraki, all of Japan

[73] Assignees: Agency of Industrial Science & Technology; Ministry of International Trade & Industry, both of Tokyo, Japan

[21] Appl. No.: 469,407

[22] Filed: Feb. 24, 1983

[30] Foreign Application Priority Data

May 20, 1982 [JP] Japan ..... 57-85297

[51] Int. Cl.[4] ..... B23B 1/00; B23B 5/40; B23B 25/06

[52] U.S. Cl. ..... 82/1 C; 51/165.72; 83/2 B; 356/376; 356/385

[58] Field of Search ..... 356/375, 376, 385; 82/1 C, 24 R, 2 B; 51/165.72, 283 R, 284 R; 409/149, 188, 195, 218; 250/571, 572

[56] References Cited

U.S. PATENT DOCUMENTS

| | | | |
|---|---|---|---|
| 2,629,936 | 3/1953 | Cronstedt | 82/1 C |
| 3,520,607 | 7/1970 | Zoot | 356/376 |
| 3,589,815 | 6/1971 | Hosterman | 356/376 |
| 3,602,594 | 8/1971 | Cook | 356/376 |
| 3,894,802 | 7/1975 | Higgins | 356/376 |
| 4,018,113 | 4/1977 | Blazenin et al. | 82/2 B |
| 4,088,408 | 5/1978 | Burcher et al. | 356/376 |
| 4,125,317 | 11/1978 | Gordon et al. | 356/376 |
| 4,139,304 | 2/1979 | Redman et al. | 356/376 |
| 4,183,672 | 1/1980 | Raber et al. | 356/376 |
| 4,188,544 | 2/1980 | Chasson | 356/376 |
| 4,199,253 | 4/1980 | Ross | 356/376 |
| 4,264,208 | 4/1981 | Haberl et al. | 356/376 |
| 4,289,400 | 9/1981 | Kubota et al. | 356/376 |
| 4,299,491 | 11/1981 | Waters et al. | 356/376 |
| 4,325,639 | 4/1982 | Richter | 356/376 |
| 4,355,904 | 10/1982 | Balasubramanian | 356/376 |
| 4,373,804 | 2/1983 | Pryor et al. | 356/376 |
| 4,412,121 | 10/1983 | Kremers et al. | 356/376 |
| 4,423,650 | 1/1984 | Decker et al. | 82/1 C |
| 4,427,880 | 1/1984 | Kanade et al. | 356/376 |

FOREIGN PATENT DOCUMENTS

| | | | |
|---|---|---|---|
| 2800618 | 7/1979 | Fed. Rep. of Germany | 82/2 B |
| 161180 | 12/1979 | Japan | 82/1 C |
| 874261 | 10/1981 | U.S.S.R. | 82/47 |

OTHER PUBLICATIONS

Diamond Turning of F 111 Windscreen Optical Engineering, Nov./Dec. 1978.

Colath Aspheric Optics SPIE, vol. 235.

*Primary Examiner*—Leonidas Vlachos

*Assistant Examiner*—Jerry Kearns

*Attorney, Agent, or Firm*—Schwartz & Weinrieb

[57] ABSTRACT

High-precision turning of a metal mirror is accomplished by causing a measuring beam to be reflected on a freshly turned area of the reflecting surface to be formed in a metal blank being turned to produce a metal mirror and, at the same time, causing reference beams to be reflected on areas turned prior to the aforementioned freshly turned area, measuring the positions of incidence of the resultant reflected beams on a position detection device thereby performing the Hartmann test on the aforementioned turned areas of the reflecting surface and, based on the results of the measurement, controlling the nose position of the cutting tool now being used in turning the reflecting surface.

3 Claims, 5 Drawing Figures

DIAMOND TURNING METHOD FOR HIGH-PRECISION METAL MIRROR

BACKGROUND OF THE INVENTION

1. Field of the Invention

The invention relates to a method for diamond turning of a metal mirror to have high precision, particularly a concave metal mirror of large diameter.

2. Description of the Prior Art

It has been heretofore customary for astronomical telescopes to use concave glass mirrors of large diameters. Manufacture of these concave glass mirrors necessitates glass blanks to be polished over long periods of time. This established practice, however, has suffered from the disadvantage that the work involved is both inefficient and costly.

The technique of diamond turning metal parts has recently advanced to the point where metal mirrors produced by this technique compare favorably with conventional optical mirrors produced from glass blanks. Thus, the advantage of metal mirrors over glass mirrors in terms of ease of handling, time required for work, and cost has come to be increasingly appreciated. Owing to the standard of the existing technique, however, high quality metal mirrors manufacturable today by this technique are limited in size to a maximum diameter of about 50 cm. Mirrors of increasingly large diameters, however, are now being demanded for use in laser nuclear fusion, solar heat power generation, atmospheric environment test, infrared telescope, and laser radar observation. Substantially all these mirrors of large diameters are concave mirrors which have spherical, parabolic, or hyperbolic reflecting surfaces. Production of concave mirrors of such large diameters with high precision by the work of turning is extremely difficult.

OBJECT OF THE INVENTION

The object of this invention is to provide a diamond turning method for a high-precision metal mirror, which effects the turning of a metal mirror of large diameter by performing diamond turning on a given metal blank while detecting the condition of turning on a real-time basis, so that the Hartmann test performed on the produced mirror surface is brought to completion at the same time that the turning work is completed.

SUMMARY OF THE INVENTION

To accomplish the object described above according to the present invention, there is provided a method for diamond turning of a metal mirror, which comprises causing a measuring beam to be reflected from a freshly turned area of the reflecting surface to be formed in a metal blank being turned to produce a metal mirror and, at the same time, causing reference beams to be reflected from areas turned prior to the aforementioned freshly turned area, measuring the positions of incidence of the resultant reflected beams on a position detection device thereby performing the Hartmann test of the aforementioned turned areas of the reflecting surface and, based on the results of the measurement, controlling the nose position of the cutting tool being used in turning the reflecting surface.

According to the method of the present invention described above, since the work of turning of the reflecting surface in the metal blank and the Hartmann test on the turned area produced in the reflection surface are carried out together, there is no need for carrying out the Hartmann test alone after the turning work is brought to completion. Further since the Hartmann test is performed on the freshly turned area and on the areas turned prior to the aforementioned freshly turned area and the nose position of the cutting tool being used in turning the reflecting surface is controlled on the basis of the comparison of the results of the Hartmann test obtained for the turned areas mentioned above, all the detailed portions of the reflecting surface to be sequentially turned can be coordinately formed relative to the whole figure of the reflecting surface so that they will jointly function as one metal mirror. The method of this invention, therefore, enables production of a metal mirror of outstanding quality and enables the produced metal mirror, irrespectively of how large its diameter may be, to be finished as an entirely well-balanced product with high precision.

BRIEF DESCRIPTION OF THE DRAWINGS

The other objects and the other characteristic features of this invention will become apparent from the further disclosure of the invention to be made hereinbelow with reference to the accompanying drawings, wherein.

DESCRIPTION OF PREFERRED EMBODIMENT

Generally, the Hartmann test is performed on a lens by placing near the lens under test a Hartmann plate having numerous perforations distributed throughout the entire area thereof, irradiating the Hartmann plate with a beam of parallel rays, tracing the rays as they pass through the perforations in the plate and through the lens and form an image at the focal position of the lens thereby rating the image-forming property of the lens. Specifically, by photographing the incoming rays immediately before and immediately behind the focal point of the lens, the exact position near the focal point of the lens at which the rays coming through the perforations in the Hartmann plate intersect the optical axis of the lens can be found and the aberration with respect to the point of incidence of the lens can be determined. Application of the Hartmann test to a concave mirror of large diameter is accomplished by allowing rays radiating from a point source $S_p$ to pass through numerous perforations formed in a Hartmann plate H and impinge upon a concave mirror M under test placed immediately behind the Hartmann plate H and causing an image formed by the reflecting rays from the concave mirror M to be photographed on a dry plate F disposed slightly behind the center of curvature of the concave mirror M.

Figure 1:
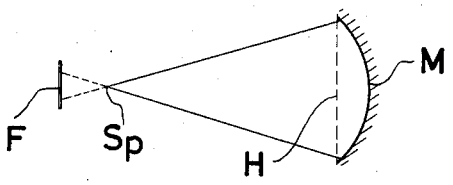
FIG. 1 is an explanatory diagram illustrating the principle of the Hartmann test performed on a concave mirror.

By this test, the figure of the mirror surface is evaluated on the basis of the positions of reflected rays photographed on the dry plate F, all as seen in FIG. 1.

This invention contemplates performing the aforementioned Hartmann test on a real-time basis with respect to the turning work being performed for the production of a reflecting surface and, at the same time, controlling the nose position of the cutting tool being used for the turning work on the basis of the results of the Hartmann test. Since the single pointed tool to be used for the turning work must be placed directly on the reflecting surface, therefore, the Hartmann plate cannot be placed as generally required. To solve this problem, the present invention effects the irradiation of the reflecting surface by scanning the reflecting surface with a laser beam from a laser source or by using a fiber grating which is capable of producing the same rays of light as are obtained by passing radiant rays from a point source through the perforations in the Hartmann plate. Further since the present invention subjects not merely the formerly turned areas but also the freshly turned area to the Hartmann test, it necessitates these turned areas to be exposed throughout the duration of this measurement in the direction of the aforementioned light source. Because this invention performs the Hartmann test on the freshly turned area and controls the nose position of the cutting tool based on the results of the Hartmann test, it follows that the measurement data of this test and the command to be issued to the nose based on the results of measurement must be transmitted with faithful response at high speed. When an interferometer is used for the aforementioned measurement, the values of measurement may possibly be altered as by unsteady flow of air and may, therefore, require extra processing as for averaging. Such extra processing causes a long delay in the response to the measurement. Thus, the adoption of the interferometer is practically impossible.

Figure 2:
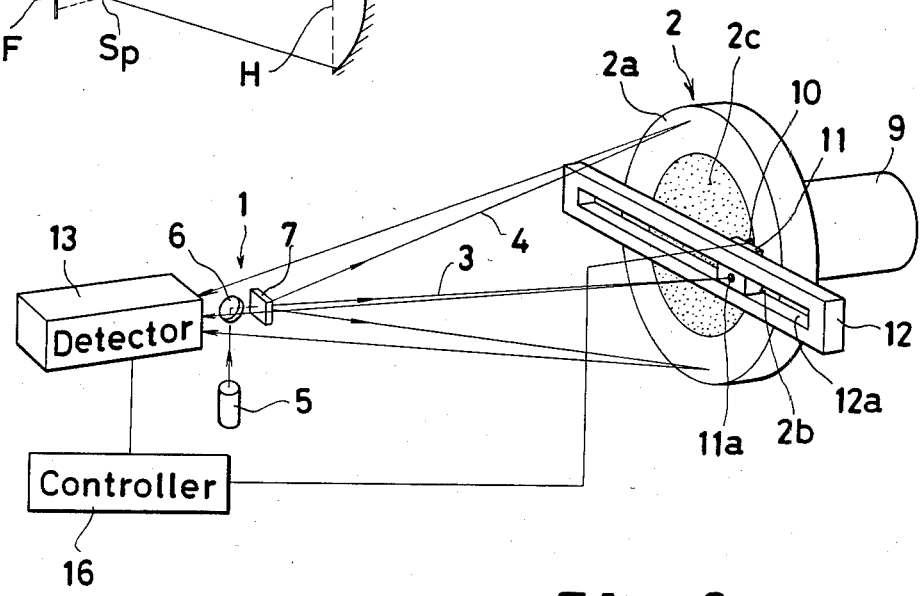
FIG. 2 is a perspective view illustrating the construction of an apparatus to be used for effecting the method of this invention.
Figure 3:
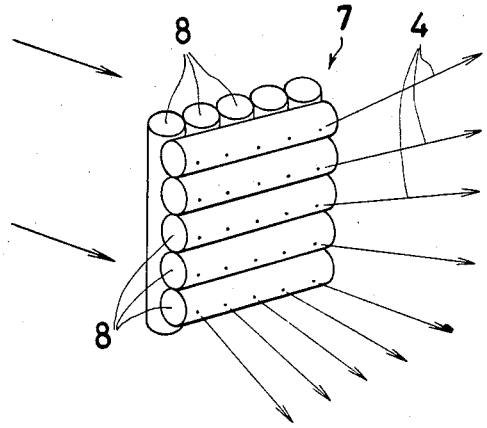
FIG. 3 is a perspective view of a fiber grating in the apparatus of FIG. 2.

FIG. 2 represents a typical apparatus to be used for effecting the present invention. In the drawing, a light system 1 serves to irradiate the reflecting surface of a metal mirror 2 being turned. It is adapted to project a measuring beam 3 onto a freshly turned area and diverging reference beams 4 on areas turned prior to the freshly turned area. It is composed of a light source 5 for issuing a laser beam, a mirror 6 for reflecting the laser beam, and a fiber grating 7 for diverging the laser beam from the mirror 6. With respect to the principle of the Hartmann test illustrated in FIG. 1, the fiber grating 7 is intended to produce a multiplicity of wide-angle reference beams 4 similar to those rays which are obtained by causing the radiant light from a point source to pass through the multiplicity of perforations in the Hartmann plate. As illustrated in FIG. 3, the fiber grating 7 is constructed by having optical fibers 8 arrayed vertically and horizontally, so that incidence of collimated laser beam upon one face of the fiber grating 7 results in production of an aray of two-dimensional point sources. Owing to the effect of their interference, there are obtained wide-angled reference beams 4, with which a formerly turned area 2*a* on the metal mirror 2 being turned is irradiated. By means of this fiber grating 7, there can be obtained bright reference beams 4 making use of a substantial part of the laser beam. Unlike the Hartmann plate, the fiber grating 7 is not required to be disposed in close proximity to the reflecting surface. When the optical fibers 8 in the fiber grating 7 are given a relatively big diameter, the angles separating the diverging reference beams 4 can be decreased and the accuracy with which the detection of the turned figure is effected can be increased proportionately. By such means as perforating in a horizontal fiber of the fiber grating 7 a hole (not shown) for permitting uninterrupted passage of the laser beam to a vertical fiber, for example, there can be obtained the horizontal plane beam which serves to uniformly irradiate a horizontal slit 12*a*. The measuring beam 3 may be obtained by using the horizontal beam irradiating the slit 12*a* of a guide base 12 which will be described more fully afterward and its vicinity and perforating in a tool rest 11 moving along this guide base 12 a hole 11*a* for selectively permitting uninterrupted passage of the incident beam.

Figure 4:
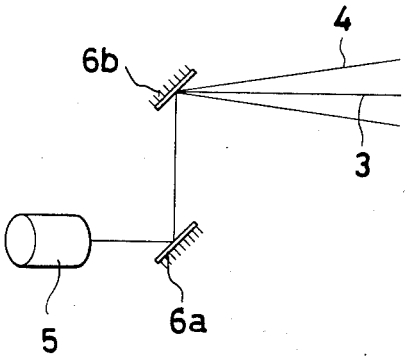
FIG. 4 is an explanatory view showing one embodiment of a method for scanning a metal mirror surface with a laser beam according to the present invention.

The method of scanning the turned area with a laser beam instead of using the fiber grating is effected by using two plane or polygonal mirrors 6*a*, 6*b* disposed as illustrated in FIG. 4 and swinging the mirror 6*a* in the vertical direction and the mirror 6*b* in the horizontal direction thereby causing the laser beam from the laser 5 to sweep the metal mirror surface 2 sequentially.

The metal mirror 2 to be irradiated with the beam from the aforementioned light source 1 has underturning work performed in the reflecting surface thereof. It is attached fast to a rotary shaft 9 as with a vacuum chuck and is adapted so as to be rotationally driven in the clockwise direction as viewed in the drawing. In the drawing, 2*c* denotes an unturned area which has undergone only underturning work.

A diamond tool 10 which effects diamond turning on the aforementioned metal mirror 2 is held fast in position by a tool rest 11. The tool rest 11 is disposed so as to be moved along the guide base 12 in accordance with commands from a controller 16. The diamond tool 10 is retained so as to be advanced forward or rearward on the order of 0.05 μm by a cutting amount controlling actuator (not shown). In the aforementioned tool rest 11, a hole 11*a* is formed in immediate proximity to the tip of the diamond tool 10, so that the aforementioned horizontal beam may be passed through the hole 11*a* to become the aforementioned measuring beam 3 and impinge upon the freshly turned area 2*b*. When this hole is provided with a suitable chopper capable of modulating the measuring beam 3, a position detector 13 which will be described fully afterward will be enabled to receive the measuring beam 3 and the reference beams 4 as clearly discriminated from each other. For the purpose of discriminating between the beams 3, 4, the measuring beam 3 may be moved to sweep along a slit 12*a* of the guide base 12. For this motion, the horizontal beam may be prepared such as by perforating a hole in a horizontal fiber.

As the cutting amount controlling actuator mentioned above, there may be used a piezo-electric element or a hydraulic nozzle flapper. The piezo-electric element enjoys advantages such as high resolution, easy control of Angstrom-order movements, and quick response.

Figure 5:
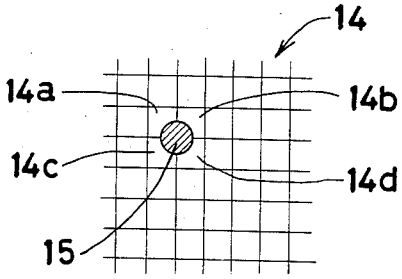
FIG. 5 is an explanatory diagram illustrating the measurement of positions of incident beams by a photoelectric conversion element used in the apparatus of FIG. 2.

The position detector 13 which serves to detect the positions of the measuring beam 3 and the reference beams 4 reflected from the turned areas on the aforementioned metal mirror 2 is provided with a sensor array made up of integrated photoelectric elements used for the aforementioned detection of beam positions. For the detection of the positions of the aforementioned beams 3, 4, a conventional two-dimensional image sensor or other similar device is too deficient in resolution for digitally indicating the positions of the beams and fails to effect the desired detection with tolerable accuracy. Detection with high resolution, therefore, is realized by causing the position of a light spot 15 falling on a sensor 14 to be interpolated with the ratio of outputs due to the amounts of light impinging upon the elements 14*a* through 14*d* as illustrated in FIG. 5.

By working the method described above with a solar cell as the photoelectric converting element, there has been obtained resolution on the order of 1/100 to 1/1000 of the size of the element. If the beams 3, 4, on reaching the surface of measurement, produce light spots about 20 μm in diameter, for example, the measurement of the surface figure can be amply obtained in a figure of about 0.05 μm on a mirror surface about 2 meters in diameter.

The controller 16 connected to the aforementioned position detector 13, in response to the signal received from the position detector 13, issues to the diamond tool 10 a signal to drive the diamond tool 10 so that the diamond tool 10 may insert a required cut into the metal blank synchronously as the tool 10 is driven as by numerical control in the direction of the slit 12*a*. The position detector 13 detects the positions of incidence of the reference beams 4 reflected on the metal mirror 2 to find the inclination of the turned area 2*a* and, at the same time, detects the position of incidence of the measuring beam 3 to find the inclination of the turned area 2*b* and applies a signal corresponding to the results of such measurements to the controller 16. The controller 16, in response to the signal from the position detector 13, issues a signal for enabling the reflecting surface of the metal mirror 2 to be turned eventually in the shape of a concave mirror of high light condensing property which closely approximates the design value. As described above, the apparatus for working the method of this invention as described above continues to turn the metal mirror 2 while carrying out the Hartmann test on the turned areas of the reflecting surface on a real-time basis.

In the issuance of the signal for controlling the diamond tool, the results of the measurement of the turned area 2*a* by the aforementioned reference beams 4 are utilized for the determination of change in the shape of the turned area immediately after turning. In the surface subjected to diamond turning, some difference is expected to occur between the shape of a given area before turning and that after turning possibly because various factors such as pressure of turning, heat of turning, strain by turning, and transformation of surface by turning are intricately interrelated. These factors pose a significant problem to attaining high-precision in the turning work. The method of this invention, therefore, can carry out high-precision turning of the reflecting surface more reliably by enabling the position of the tool being used in the turning to be directly detected by the reflected beam from the freshly turned area of the mirror surface and, after the turning work has proceeded for a prescribed length of time and consequently the turned area has stabilized, subjecting the stabilized turned area to measurement thereby permitting estimation of the change in shape after the turning, and then allowing the position of the tool to be controlled with reference to the outcome of the estimation.

In the apparatus constructed as described above, the metal mirror 2 subjected to turning is given underturning work prior to regular turning work and the tool for high-precision turning is set in position. Thereafter, the apparatus carries out the Hartmann test on the unturned area 2*c* which has undergone only the underturning work. The position detector 13 is fastened at the center of curvature which has been consequently determined. The unturned area 2*c* has not yet formed a satisfactory mirror surface and the Hartmann test has not been performed on this unturned area with amply high accuracy. The process described above nevertheless proves to be indispensable for the purpose of minimizing the amount of metal to be removed during the high-precision turning.

Then the unturned area 2*c* of the metal mirror 2 is subjected to high-precision turning by the use of the diamond tool 10 and, at the same time, the measuring beam 3 and the reference beams 4 from the light source 1 are directed toward the metal mirror 2. Consequently, the beams 3, 4 are reflected and the reflected beams are detected by the position detector 13. The shape of the freshly turned area 2*b* is found by the detection of the measuring beam 3 and the shape of the turned area 2*a* formed prior to the turned area 2*b* is found by the Hartmann test. Based on the results of such measurements, the nose position of the diamond tool 10 is controlled by the actuator through the medium of the controller 16, to effect the high-precision turning. The reference beams 4 reflected not only by the turned areas 2*a* but also by the unturned area 2*c* are detected by the position detector 13. When the reflectance of the former areas and that of the latter area differ greatly, the corresponding intensities of light are also greatly different and the beams are sufficiently discriminable. Thus, the turning work may be carried out by relying for the detection of mirror surface precision solely upon the turned areas 2*a*, 2*b* or by effecting the detection of the mirror surface precision with emphasis placed on the unturned area 2*c*. Further by increasing the number of points of measurement in proportion as the cumulative total of turned area 2*a* is increased and controlling the turning work so that the image to be formed by the beams reflected from all such points of measurement may be concentrated at the center of curvature of the reflecting surface, the entire surface of the produced reflecting mirror, large as its diameter may be, will have undergone the Hartmann test at the same time that turning work is brought to completion, making possible the production of a high-precision reflecting mirror. Optionally, the composite image of the aforementioned various beams can be recorded in the form of a hologram so that various beams may be reproduced from one hologram and utilized for the turning work.

Even when an ideal mirror surface is obtained immediately after the completion of the turning work owing to the real-time control of the turning work, there is still a possibility that the mirror surface will be deformed when it is held in the posture required in actual service. Besides, the possibility of the real-time control inducing a systematically repeated error cannot be completely denied. The correction of such errors can be realized by the learned control which results from the repetition of turning work. Thus, turning with thorough precision will be constantly obtained after the first few products, for example.

Glass concave mirrors of large diameters intended for use in astronomical telescopes, either during their manufacture or after their completion, are subjected to the Foucault test or the Ronchi test by way of qualitative evaluation or the Hartmann test by way of quantitative evaluation. It is only natural that metal concave mirrors obtained by turning should undergo the Hartmann test or these other tests. Unlike grinding work, the turning work performed for the production of a metal mirror can adopt dry work not using any mineral oil. Thus, the turned surface of a metal mirror can be immediately subjected to optical measurement. The turning work of the metal mirror, therefore, enjoys a fundamental merit that the real-time measurement of the turned area of the surface and the control of the turning work based on the results of the measurement are both feasible.

In due consideration of the various points discussed above, the present invention contemplates effecting the turning of a metal mirror of large diameter by performing the Hartmann test on turned areas of the metal blank while the turning work is in progress and, based on the results of this test, controlling the turning work. Thus, the entire surface of the produced metal mirror will have undergone the Hartmann test by the time that the turning work is brought to completion. Consequently, there is obtained a metal mirror of high-precision turned reflecting surface.

Obviously, many modifications and variations of the present invention are possible in light of the above teachings. It is therefore to be understood that within the scope of the appended claims, the present invention may be practiced otherwise than as specifically described herein.

What is claimed is:

1. A method for precision turning of a metal mirror by means of a cutting tool, which comprises the steps of:

rotating said metal mirror;

irradiating a freshly turned area of the reflecting surface of said metal mirror being turned with a measuring beam;

irradiating areas of said reflecting surface of said metal mirror, which have already been turned prior to the turning of said freshly turned area, with a plurality of diverging reference beams;

detectng the relative inclinations of said measuring beam and said plurality of diverging reference beams reflected from said freshly turned and prior turned areas of said metal mirror and generating output signals indicative of said relative inclinations of said measuring and reference beams; and controlling the position of said cutting tool in response to said control signals so as to achieve uniform turning properties over the entire reflecting surface of said metal mirror being turned.

2. A method according to claim 1, wherein said reference beams are diverged by means of a fiber grating.

3. A method according to claim 1, wherein the position of said measuring beam and said reference beams are detected with a sensor array formed of integrated photoelectric elements.

* * * * *